US006817065B1

(12) United States Patent
Brückner

(10) Patent No.: US 6,817,065 B1
(45) Date of Patent: Nov. 16, 2004

(54) DOOR HINGE

(75) Inventor: Lothar Brückner, Leonberg (DE)

(73) Assignee: Edscha AG, Remscheid (DE)

( * ) Notice: Subject to any disclaimer, the term of this patent is extended or adjusted under 35 U.S.C. 154(b) by 0 days.

(21) Appl. No.: 10/019,818

(22) PCT Filed: Jun. 28, 2000

(86) PCT No.: PCT/EP00/06005

§ 371 (c)(1),
(2), (4) Date: Apr. 3, 2002

(87) PCT Pub. No.: WO01/02683

PCT Pub. Date: Jan. 11, 2001

(30) Foreign Application Priority Data

Jul. 2, 1999 (DE) ..... 199 30 322

(51) Int. Cl.[7] ..... E05D 3/06
(52) U.S. Cl. ..... 16/366; 16/382
(58) Field of Search ..... 16/236, 239, 240, 16/360, 361, 366, 367, 368, 369, 370, 371, 235, 241; 296/146.11, 146.12

(56) References Cited

U.S. PATENT DOCUMENTS

| | | | | | |
|---|---|---|---|---|---|
| 3,065,600 | A | | 11/1962 | Preston | 60/39.35 |
| 3,095,600 | A | * | 7/1963 | Bretzner | 16/224 |
| 3,275,370 | A | * | 9/1966 | Smith | 296/63 |
| 4,665,586 | A | * | 5/1987 | Kinaga et al. | 16/319 |
| 4,665,587 | A | * | 5/1987 | Kinaga et al. | 16/370 |
| 5,074,611 | A | * | 12/1991 | Newkirk | 296/146.6 |
| 5,289,615 | A | * | 3/1994 | Banks et al. | 16/366 |
| 5,398,988 | A | * | 3/1995 | DeRees et al. | 296/155 |
| 5,632,065 | A | | 5/1997 | Siladke et al. | 16/335 |
| 5,685,046 | A | * | 11/1997 | Neag et al. | 16/366 |
| 6,030,025 | A | * | 2/2000 | Kanerva | 296/146.12 |
| 6,052,870 | A | * | 4/2000 | Hagenlocher et al. | 16/347 |
| 6,149,222 | A | * | 11/2000 | Schambre et al. | 296/146.12 |
| 6,196,618 | B1 | * | 3/2001 | Pietryga et al. | 296/146.11 |
| 6,305,737 | B1 | * | 10/2001 | Corder et al. | 296/146.11 |
| 6,386,621 | B1 | * | 5/2002 | Kozak et al. | 296/155 |
| 6,606,763 | B1 | * | 8/2003 | Bruckner | 16/366 |

FOREIGN PATENT DOCUMENTS

| | | |
|---|---|---|
| EP | 0562444 | 9/1993 |
| EP | 0596403 | 5/1994 |
| FR | 880197 | 12/1942 |

* cited by examiner

*Primary Examiner*—Robert J. Sandy
*Assistant Examiner*—Andre' L. Jackson
(74) *Attorney, Agent, or Firm*—Davidson, Davidson & Kappel, LLC

(57) ABSTRACT

A motor vehicle door hinge allows the door to be displaced relative to a doorpost in transverse and pivoting movements by means of a four-bar mechanism having a supporting arm and a control rod. The supporting arm is hingedly secured to the door's side and the doorpost by two respective hinge eyelets end areas. The control rod is coupled with a bearing plate on the door's side and the doorpost, whereby a corresponding hinge eyelet of the support arm is also coupled therewith, and with a hinge element on its end facing away from the side. The hinge acts upon the door's position by mounting the hinge element, coupled with the control rod, so that it can be displaced with and in the direction of said control rod relative to a corresponding hinge elements that is associated with a hinge eyelet of the supporting arm.

10 Claims, 3 Drawing Sheets

DOOR HINGE

FIELD OF THE INVENTION

The invention relates to a door coupling for a door of a motor vehicle.

BACKGROUND OF THE INVENTION

FR-C-880 197 describes a motor vehicle door hinge for coupling a motor vehicle door to a respective body member, wherein a four-joint mechanism connects a supporting arm at one hand and a control rod at the other hand with a bearing plate at both ends, respectively, wherein the bearing plates are respectively affixed to the motor vehicle door and to the body. Influencing the movement of the motor vehicle door hinge by changing the relative position of control rod and supporting arm is not possible.

U.S. Pat. No. 5,632,065 describes a motor vehicle door hinge, where mounting parts to be fastened to a motor vehicle door at the one end and to a pillar of a vehicle body at the other end are jointly connected with each other via a supporting arm at one hand and a control rod at the other hand such that they define a four-joint mechanism.

U.S. Pat. No. 3,275,370 describes a door which is coupled to a motor vehicle via a four-joint mechanism and in which a plate-like supporting arm is designed in the form of a rectangle arranged rearward and having four gudgeons which are arranged in the region of the corners, which define an axis inclined with respect to the vertical on each side of the supporting arm, while a control rod in the frontal region of the door controls the displacement movement of the door. In the case of the known mechanism, the hinge leaves which, together with said gudgeons, define the other part of the joints are fastened to the door assembly parts, the door and door pillar, without any possibility of fine adjustment in order to correct installation and manufacturing tolerances.

U.S. Pat. No. 3,095,600 describes a door which is coupled to a motor vehicle via a four-joint mechanism and in which an upper and a lower supporting arm having respectively laterally offset joints, and a control rod are provided, in order to arrange the door in a pivotable manner on the vehicle. In the case of imprecise fastening, this type of coupling causes at least a stiff type of coupling. All possible freedoms in the fastening of the door are required for the coupling functioning to some extent, so that asymmetrical arrangements, occurring on account of dimensional, manufacturing and installation tolerances, of the door in the corresponding opening of the vehicle body cannot be corrected.

EP-A0 596 403 describes a door which is coupled to a motor vehicle via a four-joint mechanism and in which the four-joint mechanism is formed in a four-joint hinge whose hinge brackets on the door and on the pillar each have a coupling to a joint of a supporting arm and a joint of a control rod, the supporting arm furthermore having joints which are defined by individual hinges in alignment with the supporting-arm joints which are provided on the hinge brackets. The supporting arm is circumscribed within its gudgeons by a rectangle. In order for the door to be adjustable, the control rod is divided into two halves which can be mutually fixed by screw bolts interacting via holes, as a result of which, for example, the rearward joint of the supporting arm adopts a different position relative to the frontal joint of the control rod, and thus has the theoretical possibility of changing the position of the door in the vehicle body about the vertical, in which case there are only two alternatives here. However, asymmetrical arrangements, occurring on account of dimensional, manufacturing and installation tolerances, of the door in the opening of the vehicle body cannot be corrected sufficiently precisely.

US-A4,665,586 describes a door which is coupled to a motor vehicle via a four-joint mechanism, in which an upper and a lower four-joint mechanism are each formed from a control rod and from a common, plate-like supporting arm, there being no possibility at all of correcting the orientation of the door in the vehicle body.

During installation of a motor vehicle door, the door has to be adjusted in its position with respect to the vehicle body in the x-, y- and z-direction. In this case, the x-direction stands for the direction of travel, y for the horizontal direction transversely with respect to x, and z for the vertical direction transversely with respect to x. In the case of a pivot-out door hinge, during the adjustment of the door with respect to the vehicle body a defined setting of the supporting arm of the hinge on the interior door molding also has to take place, so that the part of the interior door molding which is fitted on the supporting arm can be fixed in place in a positionally correct manner with respect to the dashboard etc. This adjustment requirement greatly reduces the adjustment options in the mounting of the door carcass onto the hinge. In the case of single-hinged pivot hinges, the adjustment in order to compensate for an angular offset between the screw-down surfaces on the door and on the door pillar can take place by determining the y- and z-coordinates. In the case of the pivot-out door hinge, this adjustment option is used up by the necessity of adjusting the supporting arm with respect to the interior door molding. Therefore, in the case of a pivot-out door hinge, an adjustment by rotating about the x-axis is additionally required. Moreover, for tolerance reasons, when installing the door it may be necessary, in the case of a multi-joint door hinge, to compensate for an angular offset between the screw down surfaces of the hinge and door panel in order to fix the positioned door onto the hinge. Such compensation can only be corrected by twisting the hinge leaf. This adjustment can take place only by changing the distance between the coupling axes of the control rod on the door and door pillar. The known solutions for changing the length of the control rod are very complicated both to produce and to install.

SUMMARY OF THE INVENTION

It is the object of the invention to provide a door coupling that enables the door position in the vehicle body to be influenced in a simple and effective manner. The door can be displaced with respect to a door pillar in a transverse movement combined with a pivoting movement by means of a four-joint mechanism, the four-joint mechanism having a supporting arm connected in an articulated manner to the door and in an articulated manner to the door pillar and a control rod connected in an articulated manner to the door and in an articulated manner to the door pillar, the supporting arm being fastened in an articulated manner with regard to the door and pillar at in each case two gudgeons assigned to the end regions of the supporting arm, wherein the control rod is of single piece design and with regard to the door or pillar is coupled to a bearing plate to which a corresponding gudgeon of the supporting arm is also coupled, and the control rod, at its end remote from this side, is coupled to a hinge part.

This object is achieved for the door coupling in that the hinge part the control rod is coupled to can be displaced jointly with and in the direction of the control rod relative to a corresponding hinge part assigned to a gudgeon of the supporting arm.

The control rod of single-piece design is coupled to a bearing plate with regard to the door or pillar to which a corresponding gudgeon of the supporting arm, preferably the lower gudgeon, is also coupled. The hinge part of the supporting arm and the hinge part of the control rod can be fastened to a door assembly part, door or door pillar, using the same screws, and this connection is hence at the same time a connection of the two door hinges, as a result of which the four-joint mechanism is defined in the four-joint hinge defined by this means. It is alternatively possible, with the same outcome, to fasten the hinge part of the control rod to the hinge part of the supporting arm and to fasten one of the two hinge parts to the door assembly part, door or door pillar, since by fastening the two hinge parts to each other the joint axes of the control rod and supporting are defined relative to each other, so that a defined four-joint hinge is formed by this means.

A particular feature of this design is that the two hinge parts can not only be connected together, but, moreover, the connection can also be displaced in the direction of the control rod, which has the consequence that the relative position of the two joint axes with respect to each other can be changed, a change in the distance between the two joint axes in the closed position of the door having the consequence of enabling said door to pivot around an axis running essentially vertically.

By providing the possibility of mutual displacement, which expediently is to take place in an infinitely variable manner, a particularly precise and sensitive correction of an offset of the motor vehicle door in the corresponding recess of the vehicle body is possible, in which case, as a function of the increase or reduction in the distance between the two joint axes, the vehicle door is pivoted around an essentially vertical axis in the direction of its rearward edge or the direction of its front edge, if it is presumed that the control rod is engaging further forward than the supporting arm.

The relative displacement of the two hinge parts can take place in a particularly simple and expedient manner by a slot running essentially in the direction of the x-axis (with the door closed) being formed in at least one of the two hinge parts, a customary screw/nut combination being passed through said slot and, when the desired position is reached, being tightened in order to finally fix the two door hinges in place. There is virtually self-centering when the door is fitted.

The door coupling according to the invention preferably has a supporting arm which can be divided into a base supporting arm and at least one supporting arm part which can be detached from said base supporting arm and comprises the two gudgeons provided on one side of the supporting arm, the base arm and supporting arm part expediently having flat sides which face each other and define a tangent plane which guides at the same time to a pivoting movement of the supporting arm part relative to the base supporting arm in the manner of a stop. The base supporting arm and supporting arm part are mutually clamped together by means for the mutual fastening, preferably screws or the like, these means being of releasable design in order to permit mutual twisting of the supporting arm part and base supporting arm around a pivot axis which is perpendicular with respect to the tangent plane. The pivot axis is defined by an axis passing through the base supporting arm and supporting arm part, said axis possibly not having the same orientation as the pivot axis, in which case the pivot axis is defined perpendicularly with respect to the tangent surfaces by the location at which the axis passes through. It is therefore possible, for example, to provide just one pin protruding out of one of the tangent surfaces in order to define the pivot axis, while the fastening at other points is provided by means of a screw connection or the like.

One particular advantage of the door coupling according to the invention is that the pivoting of the supporting arm part and base supporting arm relative to each other about relatively small angles enables the position of the door in a recess, formed for this purpose, in the vehicle body to be corrected essentially around the x- axis, which corresponds to the direction of travel in the case of motor vehicles. This enables manufacturing and installation tolerances in the fitting of the door, which tolerances lead to a visually unattractive asymmetry or tilting relative to the vehicle body, to be corrected in a particularly simple and efficient manner, a correction, particularly in the case of a four-joint mechanism which defines the pivoting-out movement of the door, at the stop points of the hinge parts on the door or door pillar being made more difficult by the fact that the determination of the position relative to the interior door molding uses up the known paths of adjustment.

In contrast, the door coupling according to the invention enables readjustment of a door which has already been fastened, in that screws are provided, preferably on the rearward supporting arm part, said screws enabling the supporting arm part to be detached and enabled around the pivot axis in order to correct the position of the door around an axis essentially parallel to the horizontal.

The tangent plane of the base supporting arm and supporting arm part is expediently not only passed through by a central or eccentric screw for defining the pivot axis, but furthermore also by further fixing and/or guide elements which are displaced on a circular path around the pivot axis in a radius corresponding to this distance from the pivot axis. For this purpose, the fixing and/or guide element, which is preferably designed as a screw, is screwed into one of the two parts—the base supporting arm and supporting arm part, while a slot, which also has a little vertical play, is provided in the other of the two parts in order to enable the screw shank to undergo, within the slot, a displacement corresponding to a short circular segment. As an alternative to a slot having vertical play, it is also possible to shape the slot to correspond to the circular segment and to reduce the play radially corresponding to the circular segment. This last variant has the advantage that the base supporting arm is effectively prevented from dropping during the pivoting on account of the vertical play of the supporting arm part.

The tangent plane is to be understood as being a plane in the widest sense, i.e. it is not required for the tangent plane to spatially coincide with a surface. Rather, it is possible for the tangent plane to comprise a plurality of sections, for example a displacement section which is laterally offset with respect to that section at which the means for fastening the base supporting arm and supporting arm part pass through the tangent plane. The tangent plane could therefore, for example, have a dome shape which, in the case of a symmetrical design, would readily permit the pivoting movement, for example. Furthermore, the tangent plane could be formed from axially offset circular sections which would likewise permit pivoting.

In the case of the arrangement according to the invention as a four-joint mechanism, the supporting arm serves essentially to transmit the load from, in particular, large and therefore heavy doors onto the motor vehicle and, in particular, onto its door pillar which is arranged in the region of the A-post. For this purpose, the supporting arm is formed in the manner of a plate body in whose four corner regions the gudgeons for the coupling to the door and to the pillar are formed. The supporting arm part is expediently fastened detachably on that side of the base supporting arm which faces the door, since it is particularly readily accessible there for adjusting the orientation with respect to the base supporting arm. However, it is also possible, as an alternative thereto or in addition thereto, to provide a supporting arm part on the frontal side of the supporting arm, which side is coupled to the door pillar, as a result of which, in a manner which is similar and scarcely changed in outcome, the orientation of the door in the recess left free in the vehicle body can be influenced by rotation around the x-axis. However, it will, as a rule, be sufficient to provide just a two-part design of the supporting arm.

It should be noted that the supporting arm part, the two supporting-arm gudgeons being formed integrally on it, connects in respect of their alignment and spacing the two gudgeons in the manner of a strip and thus provides the supporting arm part to form an integral part to become a mass-produced product which can therefore be positioned without any outlay on adjustment, with the result that even by means of a four-joint mechanism the door coupling according to the invention obtains an adjustability (which is otherwise not present) of the position of the door around the x-axis.

A significant advantage of the two- or multi-part design of the supporting arm also resides in the more economical possibility of producing the base supporting arm from an extruded profile, in which the region between the gudgeon portion bearing the gudgeons is produced as an independent supporting arm part and is not obtained as a costly waste of material. In addition, the base supporting arm can be produced cost effectively by extrusion, as a result of which the mechanical further processing in order to expose the gudgeon portion is additionally dispensed with.

Further advantages and features of the invention emerge from the dependent claims and from the following description.

The invention will be explained in greater detail below using an exemplary embodiment with reference to the attached drawings.

BRIEF DESCRIPTION OF THE DRAWINGS

FIG. 1 shows, in a perspective illustration, a door coupling which is denoted by 1 and pivotably arranges a door 2, which is indicated by a dash-dotted line, on a door pillar 3, likewise indicated by a dash-dotted line. The door coupling 1 is undertaken by a four-joint mechanism, the bars of which are, on the one hand, a supporting arm 4 and, on the other hand, a control rod 5. The supporting arm 4 and the control rod 5 are coupled in an articulated manner via corresponding hinge parts to the door pillar 3, on the one hand, and to the door 2, on the other hand.

Figure 1:
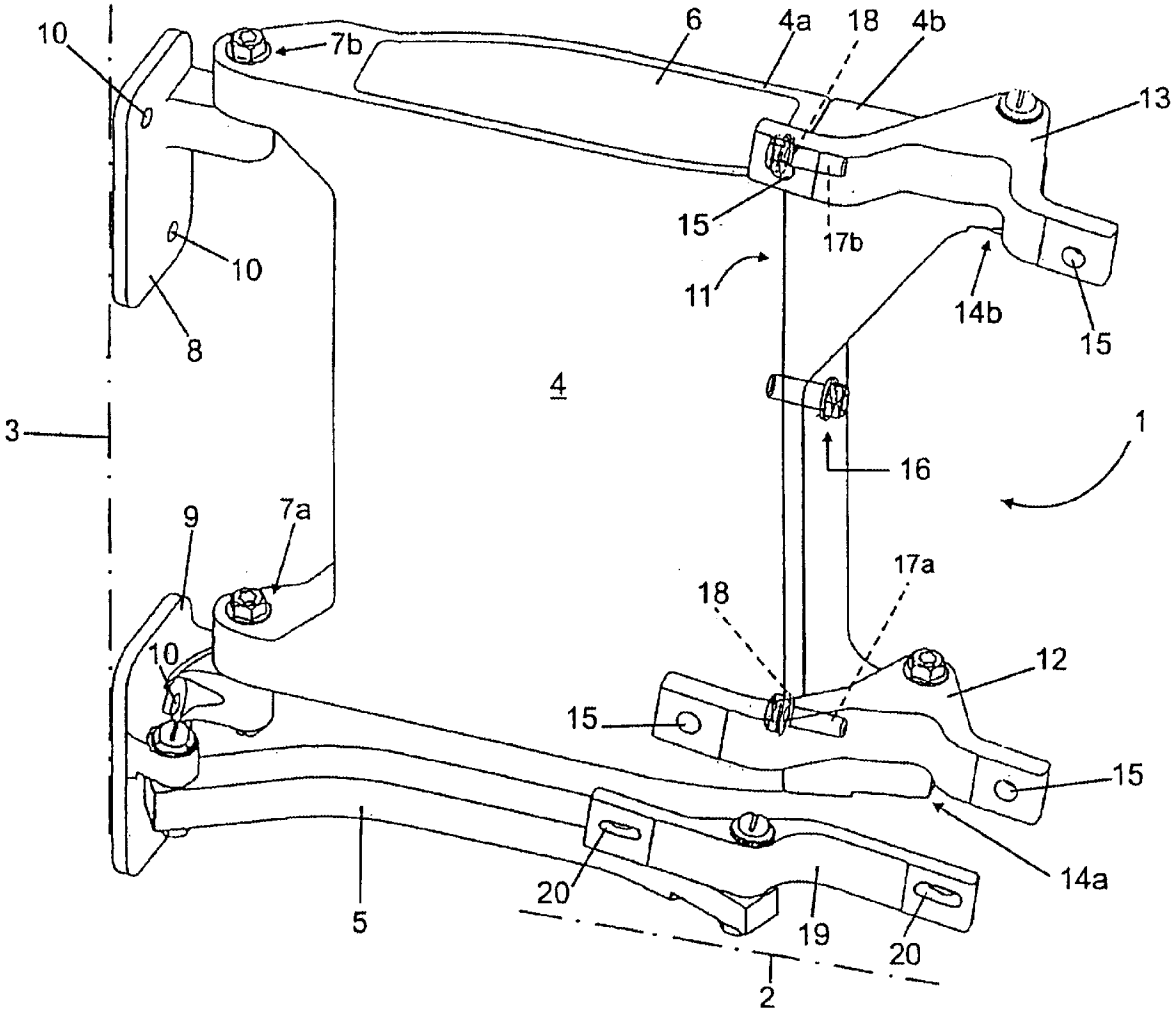
FIG. 1 shows a perspective view of a preferred exemplary embodiment of a door coupling according to the invention.

The supporting arm 4 is of plate-like design and defines in its interior a hollow space 6 in which ribs or the like, which divide the hollow space into a number of can be provided in order to increase the stiffening. The cavity 6 is expediently designed such that it is open upward and downward and thereby opens access to the interior region of the supporting arm 4. In its corner regions, the supporting arm 4 has in each case two door pillar gudgeons 7*a*, 7*b* and two door gudgeons 14*a*, 14*b*, said gudgeons being intended for coupling to hinge parts correspondingly fastened to the door pillar 3 and to the door 2. The gudgeons are provided in the vicinity of the outer corners of the supporting arm 4, the supporting arm 4 running in a plane arranged essentially vertically. The door pillar gudgeons 7*a* and 7*b* are respectively formed in the lower region and in the upper region of that corner of the narrow side of the supporting arm 4 which faces the door pillar 3, the gudgeon 7*b* being coupled in a known manner to a hinge part 8 and the gudgeon 7*a* being coupled in a known manner to a hinge part 9. The hinge parts 8, 9 are fastened to the door pillar 3 in a known manner by means of a screw connection and holes 10 provided for this purpose in the hinge parts 8 and 9. The door pillar end of the control rod 5 is also coupled to the hinge part 9, so that the hinge part 9 has two joints having a fixed distance from each other.

The supporting arm 4 is divided into a base supporting arm 4*a* and a supporting arm part 4*b*, the base supporting arm 4*a* and supporting arm part 4*b* butting against each other along a common tangent plane 11 and being held with respect to each other. The base supporting arm 4*a* is of integral design with the gudgeon portions bearing the gudgeons 7*a*, 7*b*, while the supporting arm part 4*b* for its part connects the gudgeon portions, on which the gudgeons 14*a*, 14*b* defining the coupling to hinge parts 12, 13 fastened to the door 2 are arranged, via a strip of narrow design in between them. The hinge parts 12, 13 are designed to have two wings and have holes 15 which pass through their wings and by means of which they can be connected to the door 2 directly or via an intermediate element, for example in the form of a bored spacer.

Figure 2:
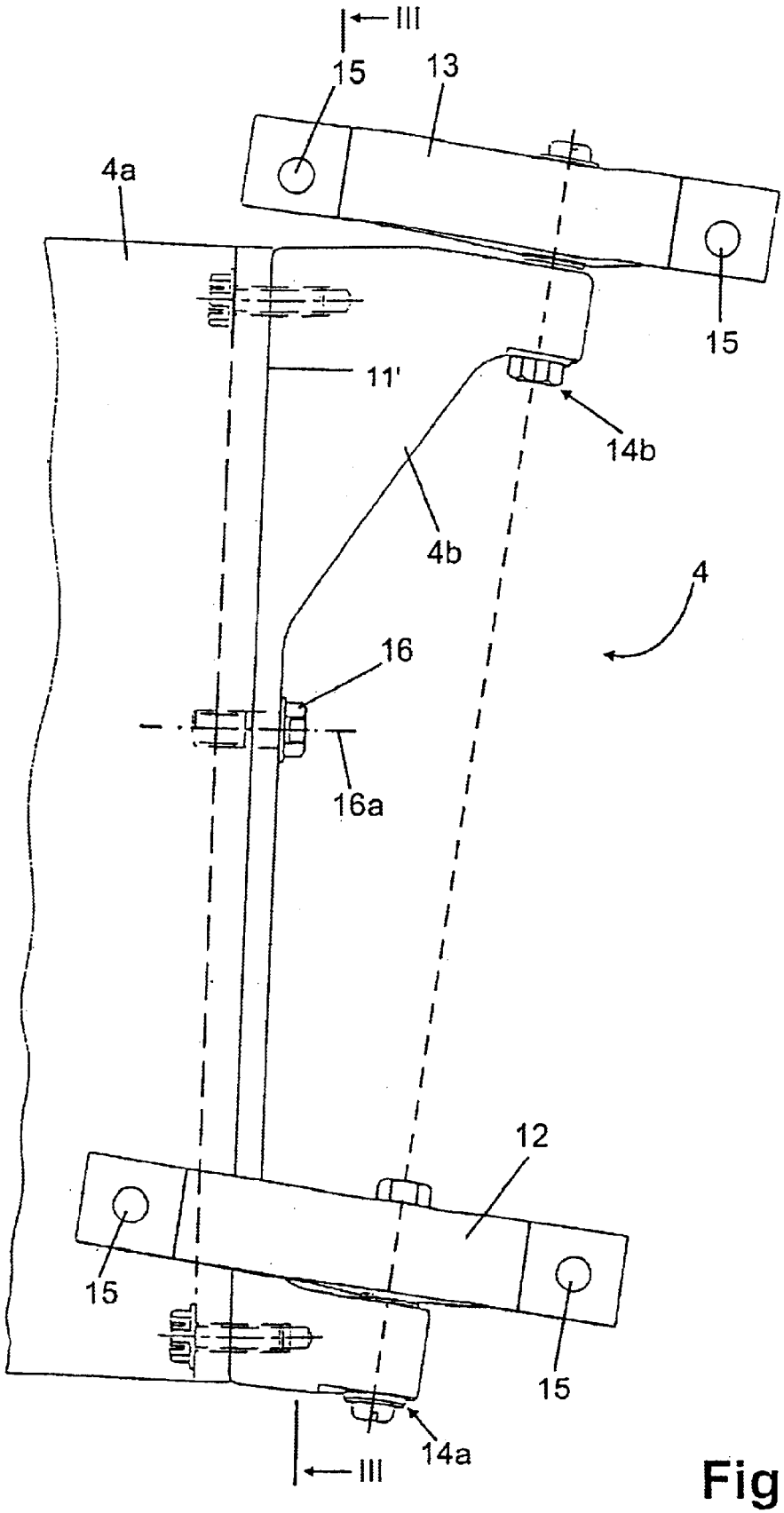
FIG. 2 shows a perspective view of the door end of the supporting arm of the coupling from FIG. 1.
Figure 3:
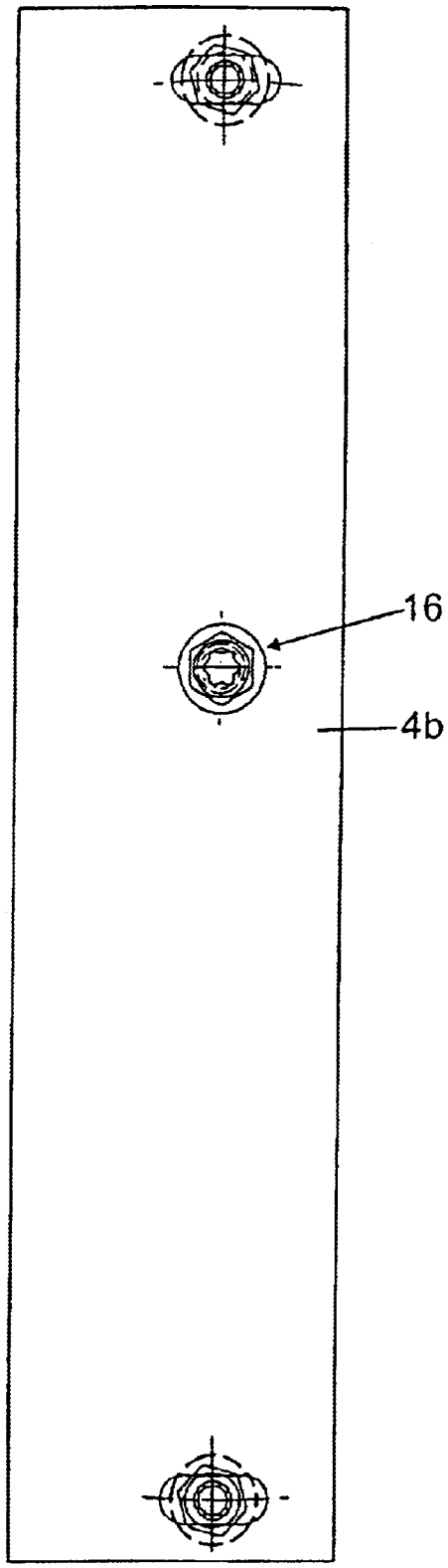
FIG. 3 shows a partially cutaway view through the supporting arm along the line III–III from FIG. 2.

As can also be seen better in FIGS. 2 and 3, the tangent plane 11, which may be both a solid and a perforated surface, is passed through by a screw 16 which is provided in the corresponding holes of the base supporting arm 4*a* and supporting arm part 4*b*, is arranged accessibly on the outside of the supporting arm 4 and is secured by a nut which is accessible in the hollow space 6. As an alternative, it is also possible to provide, for example, the hole remote from the screw head with a thread.

It can be seen that the screw 16 runs perpendicularly with respect to the tangent plane 11 and that the screw axis 16*a* runs essentially perpendicularly with respect to the tangent plane 11. The screw axis 16*a* therefore coincides with a rotational axis around the shank of the screw 16 of the supporting arm part 4*b* around the base supporting arm 4*a* when in the region of the tangent plane 11, by releasing the screws 17*a*, 17*b* provided for fixing the two parts 4*a*, 4*b* in place, a gap between the supporting arm part 4*b* and base supporting arm 4*a*, which permits pivoting, is released. In this connection, the screws 17*a, b* not only form fastening elements, but also guide elements which are defined in the manner of a cam by means of a hole, which is designed as a slot 18 and corresponds to a cam path, in that end surface of the base supporting arm 4*a* which faces the supporting arm part 4*b*. It has to be understood that that end surface of the base supporting arm 4*a* which at the same time defines a stop for the supporting arm part 4*b* is formed at least as a flat wall section in these regions in which the slots 18 are formed. Those regions of the end surface of the base supporting arm 4*a* which are not passed through by screws 17 do not necessarily have to have the end wall being closed by the material of the base supporting arm.

It can be seen in that even in the case in which the screw makes use of a slope and does not run perpendicularly with respect to the tangent plane 11, or in the case where the tangent plane 11 does not form a two-dimensional surface, the pivot axis 16*a* lies in the perpendicular with respect to the boundary surface 11'. It would therefore be possible, instead of the screw 16, to form a snug-fitting shank which protrudes out of the boundary surface 11' of the one part and passes through a corresponding hole of the other part, in which case the shank axis does not necessarily have to coincide with the perpendicular of the tangent plane. It can furthermore be seen that the screw 16 is not situated centrally between the screws 17*a* and 17*b*, but rather is situated eccentrically with respect to a central position, which is advantageous for certain applications, although it is arranged in the vicinity of the central position. The position of the screw 16, the axis 16*a* of which defines the pivot axis in the present case, is defined with regard to the dimensions of the door 2, the screw axis 16*a* in a first approach running approximately at the height of a horizontal alignment axis of the door 2, for the adjustment of which the relative adjustability, as explained below in detail, of the supporting arm part 4*b* and base supporting arm 4*a* can advantageously be used.

It can be seen in particular from FIG. 2 that the screws 17*a*, 17*b* are inserted into corresponding threads of those gudgeon portions of the supporting arm part 4*b* which bear the gudgeons 14*a*, 14*b*, it being possible instead also to secure them by a nut outside the gudgeon portions. The connection in the region of the gudgeon portions enables the connection of the base supporting arm 4*a* and supporting arm part 4*b* to be particularly strong. However, it is advantageously also possible to move the screws 17*a*, 17*b* closer to the screw 16 in order thereby to reduce the amount of displacement, caused by the pivoting around the axis 16*a*, along a circular segment corresponding to the distance from the screw 16 and defining a radius of the circle.

It can be seen in particular in FIG. 3 that the slots 18 not only constitute a hole which is elongated with respect to the shank diameter of the screws 17*a*, 17*b*, but also the height of the slots is enlarged with respect to the shank diameter, as a result of which it is expediently possible for the screws 17*a*, 17*b* to execute a rotational movement in the slots 18, said movement comprising displacement components in two dimensions in accordance with trigonometrical regularities. The door end of the control rod 5 is coupled to a two-wing hinge part 19 which can be fastened to the door 2 via slotted holes 20. The hinge part 12 and the hinge part 19 define a fitting state of the control rod 5 and supporting arm 4 enabling displacement in the direction of the long slot axis of the slot 20, the fastening of hinge parts using slots having been proved in practice and division of the control rod 5 therefore becoming superfluous. By means of relative displacement of the hinge parts 12 and 19 with respect to each other along the shanks of the screws or bolts, which shanks pass through the holes 15 and the slotted holes 20, the holes 15 holding the screws in a virtually play-free manner in the present exemplary embodiment, it is possible to adjust the distance between the door joints of the control rod 5 and supporting arm 4 to a limited extent, thereby essentially enabling displacement of the vehicle door 2, which is fastened to the door parts 13, 12, 19, around a vertical axis, so that the position of the door 2 in the vehicle body can be corrected.

In the present exemplary embodiment of the door coupling 1 according to the invention, in order to adjust the position of a motor vehicle door 2 two degrees of freedom can now advantageously be used in order to correct the position of the door 2, said door otherwise not fitting centrally and therefore in a visually pleasing manner due to machining and manufacturing tolerances, even though the four-joint mechanism of the coupling 1 is defined by a four-joint hinge 9, 5, 4, 12/19 and would not in itself permit such changes. By pivoting around the axis 16*a* of the screw 16, the door 2 can be aligned about an axis corresponding essentially to the x-axis of the vehicle (direction of travel), and by displacement along the slot 20 the vehicle door 2 can be pivoted about the z-axis (vertical). It should be taken into consideration here that on account of the specific requirements of the door coupling 1 the axes 16*a* and the joint axes of the door joints of the supporting arm 4 and of the control rod 5 often do not coincide in an ideally typical manner with the x- and z-axes of the vehicle in the closed state of the door, for example because the transverse movement combined with the pivoting movement is intended to execute a path in space. Even in these cases, adjustment of the position of the door is possible because the two adjustment options enable, in an iterative process, those door positions to be adjusted in which the corresponding components of the adjustment make possible an optimum alignment of the position of the door 2 additively around the x- and around the y-axis.

In the exemplary embodiment, the hinge parts 12 and 19 are connected to each other via in each case their two hinge leaves which are to be fastened to the door and are passed through by a common bolt. It is to be noted that it is readily possible to connect, for example, only the left hinge wing of the hinge part 19 with the left hinge wing of the hinge part 12 and then optionally to connect one of the two right hinge wings of the hinge part 12 or the hinge part 19 to the door 2, the connection to the supporting arm 4 being expediently selected for static reasons.

The invention has been explained in greater detail above with reference to a preferred exemplary embodiment, it being possible for further refinements of the divided control rod 4, as divided in two in the middle or divided in three parts, likewise to be realized in order to improve the adjustability of the position of the door in the corresponding recess of the vehicle body with simultaneous ability to pivot around the x-axis of the vehicle.

What is claimed is:

1. A door coupling for a door of a vehicle, in which the door can be displaced with respect to a door pillar in a transverse movement combined with a pivoting movement by means of a four-joint mechanism, the four-joint mechanism comprising a supporting arm connected in an articulated manner to a door attachment part to be attached to the door and in an articulated manner to a door pillar attachment part to be attached to the door pillar at in each case two gudgeons assigned to the end regions of the supporting arm, the four-joint mechanism comprising a control rod of single piece design connected in an articulated manner to one of said door attachment part and said door pillar attachment part at a first end of said control rod, wherein a second end of the control rod, remote from said first end of said control rod is coupled to a control rod attachment part, and wherein the control rod attachment part can be displaced jointly with and in the direction of the control rod without changing position of said door attachment part and said door pillar attachment part.

2. The door coupling according to claim 1, wherein the hinge part which is assigned to the remote end of the control rod can be displaced relative to the corresponding hinge part of the supporting arm by a slot being formed in at least one of the two hinge parts.

3. The door coupling according to claim 1, wherein the hinge parts displaceable relative to each other can be fastened via screws to the door, and that, in at least one of the door hinge parts, holes are provided as slots in the direction of the x-axis of the vehicle for receiving the screws.

4. The door coupling according to claim 1, wherein the supporting arm comprises a base supporting arm, at least one supporting arm part which can be detached from said base supporting arm and means for the mutual fastening of the base supporting arm and supporting arm part, wherein the at least one supporting arm part comprises the two gudgeons provided at one end of the supporting arm, and wherein an axis passing through a tangent plane defined by facing surfaces of the base supporting arm and the supporting arm part allows adjustment of the supporting arm part with respect to the base supporting arm by mutual twisting around a pivot axis which is substantially perpendicular with respect to the tangent plane.

5. The door coupling according to claim 4, wherein the pivot axis is arranged between the gudgeons of the supporting arm part, and, at a distance from the pivot axis, at least one fixing and guide element passes through the tangent plane of the base supporting arm and supporting arm part.

6. The door coupling according to claim 5, wherein the fixing and guide element at least comprises a slot which is formed along a circular arc around the pivot axis in the end side of the base supporting arm or the supporting arm part and a hole which is arranged on the corresponding circular arc in the side of the respectively other part of the base supporting arm and supporting arm part, the supporting arm part being releasably fixable in each rotational position with respect to the base supporting arm by means of at least two spaced-apart fixing elements, on the one hand in the pivot axis and on the other hand on a circular arc at a distance thereto.

7. The door coupling according to claim 5, wherein the fixing and guide elements comprise a screw and nut element.

8. The door coupling according to claim 4, wherein the at least one supporting arm part faces the door.

9. The door coupling according to claim 4, wherein the axis passing through the tangent plane is the axis of a screw and coincides with the pivot axis.

10. The door coupling according to claim 4, wherein, with the door closed, the pivot axis lies essentially in the horizontal and parallel to the direction of travel of the motor vehicle.

* * * * *